US007534946B1

(12) United States Patent
Oxenhandler

(10) Patent No.: US 7,534,946 B1
(45) Date of Patent: May 19, 2009

(54) PLANETARY STRING WINDER TOOL FOR MUSICAL INSTRUMENT

(76) Inventor: Alan Lloud Oxenhandler, 11750 Casa Grande Dr., St. Louis, MO (US) 63146

( * ) Notice: Subject to any disclaimer, the term of this patent is extended or adjusted under 35 U.S.C. 154(b) by 0 days.

(21) Appl. No.: 12/154,007

(22) Filed: May 19, 2008

Related U.S. Application Data

(60) Provisional application No. 60/938,661, filed on May 17, 2007.

(51) Int. Cl.
*G10D 3/04* (2006.01)

(52) U.S. Cl. ..... 84/298

(58) Field of Classification Search ..... 84/458, 84/454, 303–306, 297 S, 297 R
See application file for complete search history.

(56) References Cited

U.S. PATENT DOCUMENTS 3,706,254 A 12/1972 Morin
4,791,849 A 12/1988 Kelly
5,272,953 A 12/1993 Koch
2007/0193430 A1* 8/2007 Jang ..... 84/313

* cited by examiner

*Primary Examiner*—Kimberly R Lockett

(57) ABSTRACT

A musical instrument string winder designed for faster tightening or loosening of a guitar key or similar that utilizes a planetary gear drive includes a handle housing with a protruding key socket near its periphery to accept a guitar key. The key socket has a recess for engaging a guitar key on one end and an integral planet gear on another end. The handle has a gripping portion one end and a relatively large integral ring gear on another end. The key socket planet gear has a predetermined diameter which is notably less than the diameter of the ring gear to afford it orbital movement around the ring gear. The key socket planet gear rotates on its own axis, subject to its position along the ring gear and is mated to a connecting element that is rotatably mounted to the center of the handle housing. Thus when the guitar key and key socket planet gear are engaged and the handle housing is held steadfast while being moved in a cyclic motion generated from the elbow in an arc defined by the ring gear, the planet gear is urged to track along an orbit defined by the ring gear, resulting in more than one rotation of the musical instrument key for each cycle of the handle. Other embodiments are described and shown.

15 Claims, 6 Drawing Sheets

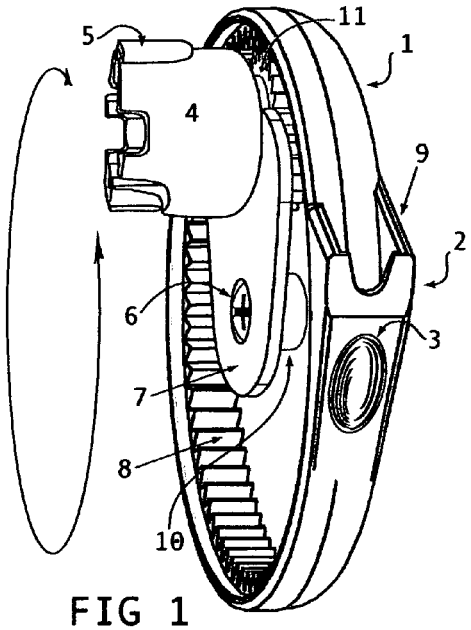
FIG 1
FIG 2
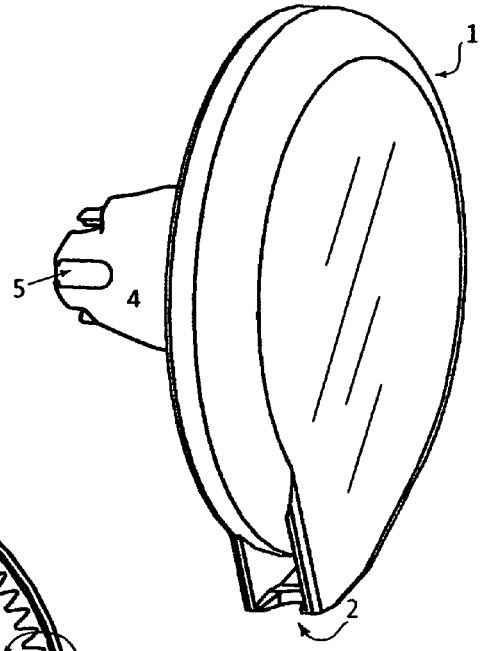
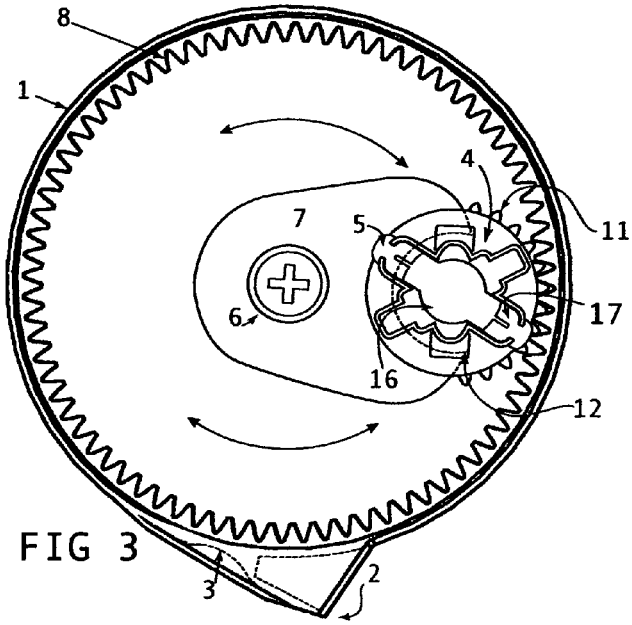
FIG 3

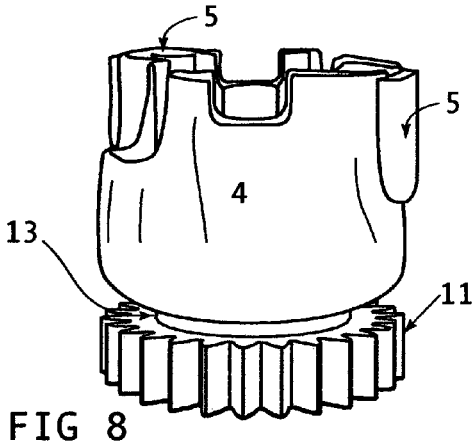
FIG 8
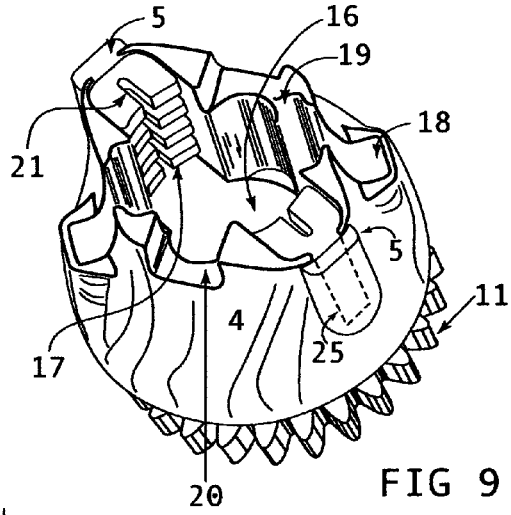
FIG 9
FIG 10
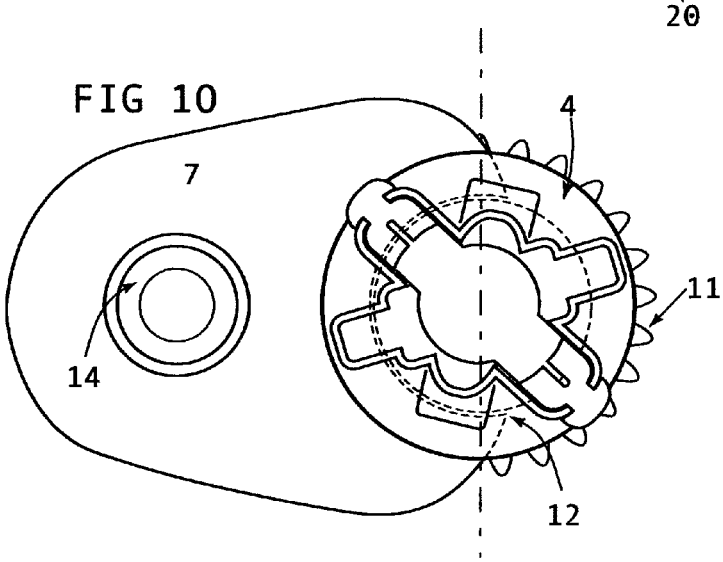

PLANETARY STRING WINDER TOOL FOR MUSICAL INSTRUMENT

CROSS-REFERENCED TO RELATED APPLICATIONS

If allowed, this application claims the benefit of provisional patent application Ser. No. 60/938,661, filed 2007 May 17 by the present inventor.

FEDERALLY SPONSORED RESEARCH

Not Applicable

SEQUENCE LISTING OR PROGRAM

Not Applicable

BACKGROUND

1. Field of Invention

This invention relates generally to accessories for stringed musical instruments, and in particular to string winding devices.

2. Prior Art

In guitars and other stringed musical instruments, a musician is required to change strings not only for sound aesthetics, but also if he encounters a broken or deteriorating string. If the old guitar string is intact, it must be unwound fully before a new one can be installed. On most acoustic or non-electric guitars, each string will need to be freed from a revolving stem and threading hole at the top of the instrument as well as from its anchoring bridge pin at the string's opposite end. This bridge pin must be completely extracted for string removal. A process that usually requires a prying device that is suited to achieving pin extraction without marring either the instrument or the pin, such as the prying feature included on U.S. Pat. No. 2,812,682. After selecting the new string, there is usually considerable slack which must be taken up by manual turning of the string winding key. As for reinserting and setting the anchoring pin, this task is usually accomplished by pushing the pin back in as securely as needed, typically by use of the thumb. This can be a painful task, because considerable force is often required for a secure seating of this pin.

For many years, simple crank-style tools such as U.S. Pat. No. 3,706,254 have been available to ease the winding motion, thereby quickening the tightening or loosening of strings during changing. A simple cranking motion tightens or loosens a selected string. Most of these types of tools provide a 1:1 ratio which can be vexing since most guitar tuning mechanisms have gear ratios of 15:1 or greater. The string winder in U.S. Pat. No. 5,272,953 does include a gear chain to increase turning ratio, but offers limited application due to the single slot design of its key insert and it too must be cranked by what could be tiring wrist motion. Also, it offers no additional guitar tools.

More recently with the proliferation of battery powered screwdrivers, guitar key adaptors have been introduced which allow those drivers to work with guitars, thereby bypassing the tiring motion associated with the task. Challenges persist however since power drivers generally are designed for high torque demands and do not readily exploit the typically low torque state of the guitar key in string maintenance. Also, since there are dozens of types and sizes of guitar winding keys on various instruments, the challenge of aligning the axis of the motorized driver and its attached key insert socket with the guitar key axis becomes evident. It will be noted that the motorized winder in U.S. Pat. No. 4,791,849 utilizes a simple socket design that provides no axis aligning component for the myriad of instruments on the market. Misalignment can reduce the benefit of using these adaptors or drivers and in some cases could distort a guitar key stem out of alignment during use. Additionally there are issues due to battery drainage or power outlet availability as well as the impracticality of stowing a drill or power driver in a guitar case or accessory bag.

SUMMARY

It has been shown that a lot of manual effort is required to tighten or loosen strings of a musical instrument such as a guitar. Conventional tools have not provided more than one rotation of the instrument key for each crank of the tool or do not address bridge pin maintenance at all. These problems are overcome according to the present invention by a musical instrument string winder utilizing a planetary gear.

BRIEF DESCRIPTION OF DRAWINGS

Figures

FIG. 1 is a perspective of the string winder showing its handle housing having an integral ring gear. A trail is of the rotating planet gear is seen.

FIG. 2 is a perspective of the rear of the tool, the handle housing.

FIG. 3 shows a front elevation of the tool with moving parts shown.

FIG. 8 shows a perspective of an integral key socket and planet gear with a recessed collar.

FIG. 9 is a detailed perspective view of the integral key socket and planet gear which depicts a multitude of recess slots and a pliable flexible, multi-firmed axial stabilizer element.

FIG. 10 shows an elevation of the key socket as snapped in place being mated to an armature.

DRAWINGS

Reference Numerals

Figure 4:
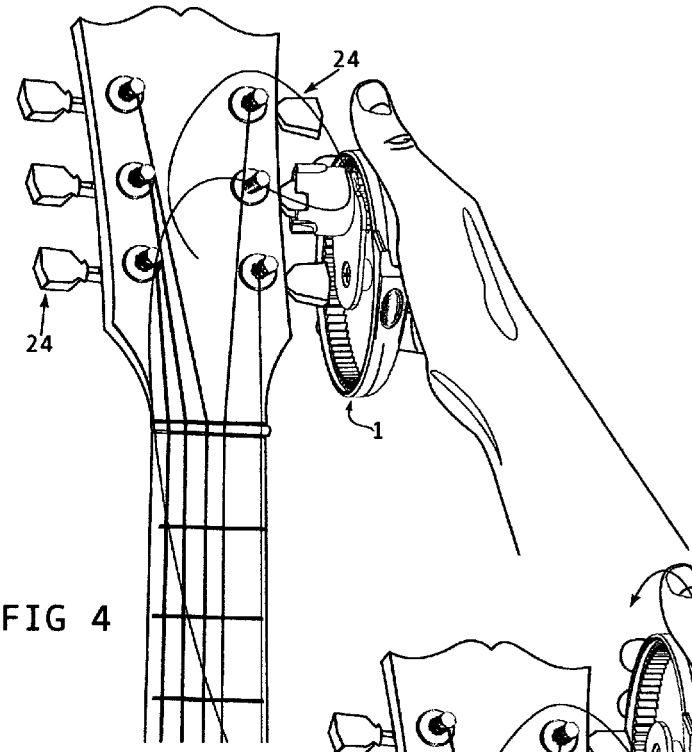
FIG. 4 is a perspective of the string winder as engaged with a guitar key with which it may be employed.

| | |
|---|---|
| 1 housing | 2 pin extractor |
| 3 pin setter | 4 key socket |
| 5 insert lock | 6 fastener |
| 7 armature | 8 ring gear |
| 9 pin tool structure | 10 connector spacer |
| 11 planet gear | 12 retaining jaw |
| 13 key socket collar | 14 armature collar |
| 15 center boss | 16 base cushion |
| 17 stabilizer slot | 18 long narrow slot |
| 19 deep rectangle slot | 20 oval slot |
| 21 fin grooves | 22 guitar pin |
| 23 string anchor | 24 guitar key |
| 25 stabilizer track | |

DETAILED DESCRIPTION

FIGS. 1, 2 and 3—Preferred Embodiment

One embodiment of the string winder 1 which can be engaged with a string winding key to quickly tighten or loosen guitar strings or similar.

In FIG. 1, 2 the string winder is shown in perspective with FIG. 3, 6 showing front and back elevations. The string winder 1 has a key socket 4 and an integral gear 11 on one end and a multitude of recess slots for engaging any one of a variety of styles and sizes of guitar keys on the other end. The key socket 4 is mated to a rotatably mounted armature 7 that is fastened to a center boss by an integral spacer 10 and a fastener 6. The key socket 4 can rotate freely on its axis within a snap-in retaining jaw 12 on the armature 7, contingent upon its position along the ring gear 8. A comparison of FIGS. 1, 2 and 3 will show that the ring gear 8 is integral to the handle housing 1, which has relatively flat portion on the back side for easily holding the string winder and operating it. As long as the diameter of the planet gear 11 is less than the diameter of the ring gear 8, a greater than 1:1 turning ratio will be achieved by every rotation of the string instrument tool around a guitar key.

Generally, a circumferential ratio of 3:1 between the ring gear 8 and the planet gear 11 can work well with little resistance. However this ratio could be more or even less, e.g. five times greater or only two times greater or less depending upon other limiting factors. While the material of the key socket 4, handle housing 1, and gearing 8, 11 and armature 7 is not critical they could be conveniently fabricated from a Nylon material or a similarly stiff polymer. The key stabilizer 5, 17 however would need to be a more pliable rubber or foam rubber with a durometer compatible to a rebounding flexibility upon contact. However, another mechanical means of centering an inserted guitar key could suffice, such as a spring. The fastener 6 would likely be of steel fabrication, though the embodiment could preclude the need for a steal fastener.

Operation

FIGS. 4, 5, 7, 9 and 10

Figure 5:
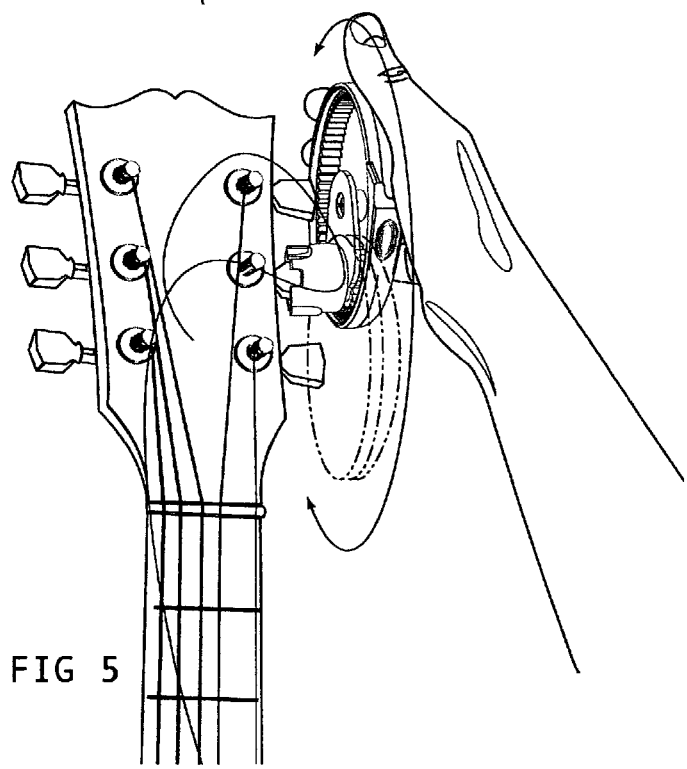
FIG. 5 shows a perspective view of actuation of the string winder with a guitar key. A wide circular motion urges a planet gear along a ring gear.
Figure 6:
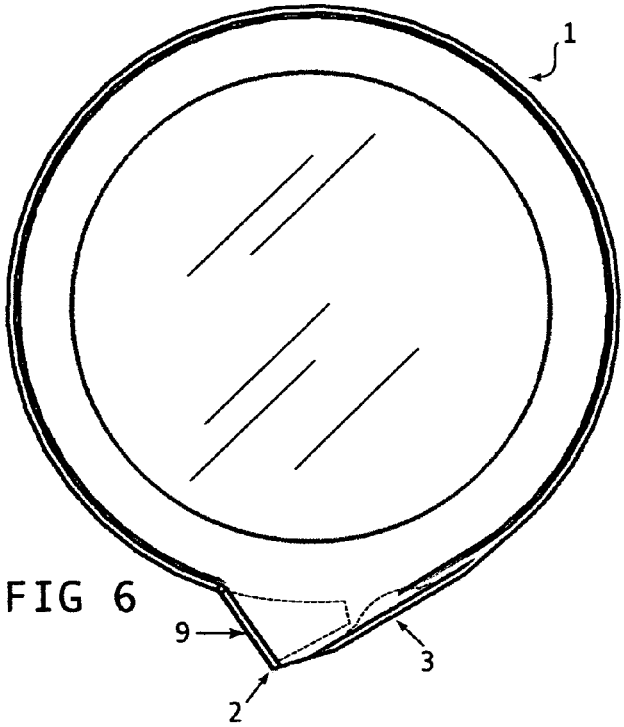
FIG. 6 shows a rear elevation of the handle housing. The outline of an integral pin tool structure with a bridge pin puller and bridge pin setter is seen at the bottom.

In FIG. 4, the string winder is shown engaged with a guitar key 24 and is ready for movement. Due to the necessity of axial alignment between the key socket 4 and the guitar key 24, one of the key slots shown in FIG. 9: 17, 18, 19 or 20 is chosen to best match the dimension of the particular guitar key 24. In FIG. 5, the housing of the string winder 1 is parallel with the neck of the guitar as motion is generated from the elbow while keeping the wrist straight. There is no need for use of the wrist in this motion; The axle of the guitar key 24 acting as an anchor point remains axially aligned with the key socket 4. As a circular movement that follows the arc of the ring gear 8 is commenced, the planet gear 11 is urged to move along the ring gear 8 which in turn rotates the guitar key 24 at a predetermined ratio.

Figure 7:
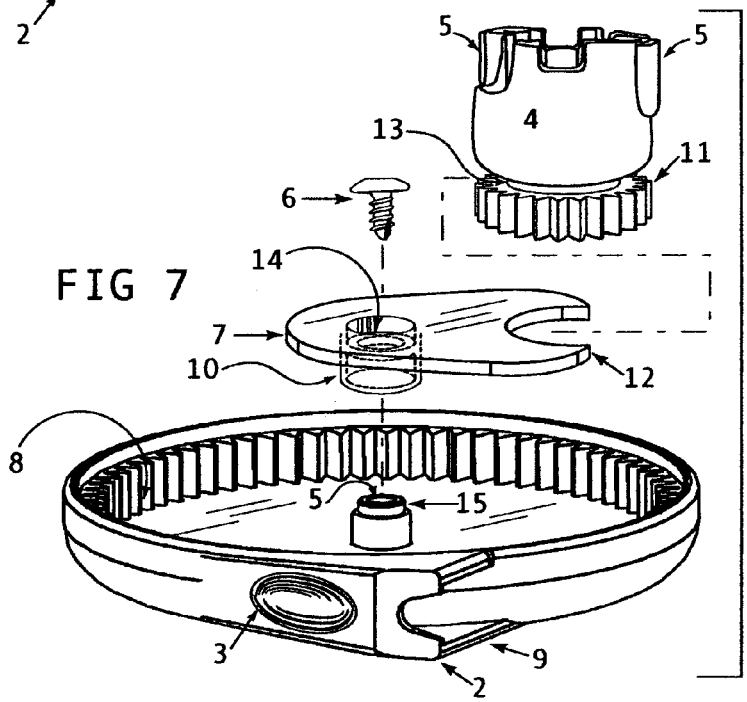
FIG. 7 is an exploded view of the string winder tool showing the integral key socket and planet gear, a connecting armature with a C-shape snap-in retaining jaw, a screw and a center boss. This view affords a clear depiction of a bridge pin structure which includes a bridge pin puller and a bridge pin setter recess as well.

The exploded view FIG. 7 shows the integral key socket planet gear 4, 11 and how it snaps into the retaining jaw 12. The opening of this jaw, see FIG. 10 and retaining jaw 12, is slightly less than the diameter of the key socket collar 13 so that it is permanently mounted in place with a forceful click. The armature 7 incorporates an integral collar 14 which maintains proper tolerance when fastened by 6. Connector spacer 10 further assures optimal alignment of armature 7 and key socket 4. FIGS. 8 and 9 afford a closer look at the integral key socket 4 and planet gear 11. The pliable key stabilizer slot fins 17 are connected at the bottom of 4 via a base cushion 16 that prevents scratching of instrument keys. The U-shape key stabilizer slot fins 17 and the center fin grooves 21 of this component afford the user a slot that maintains a tension on either side of an engaged guitar key to assure its axial alignment within the key socket 4. This slot may be used if the other key slots, 18, 19 or 20 do not fit well enough to maintain a guitar key's axial alignment to the center of key socket 4. The insert locks 5 keep the insert fastened in stabilizer track 25 and also allow for easy removal of the fins 17 via stabilizer track 25 so that they can be modified by trimming or replacement altogether.

Operation of Bridge Pin Tools

Figure 11:
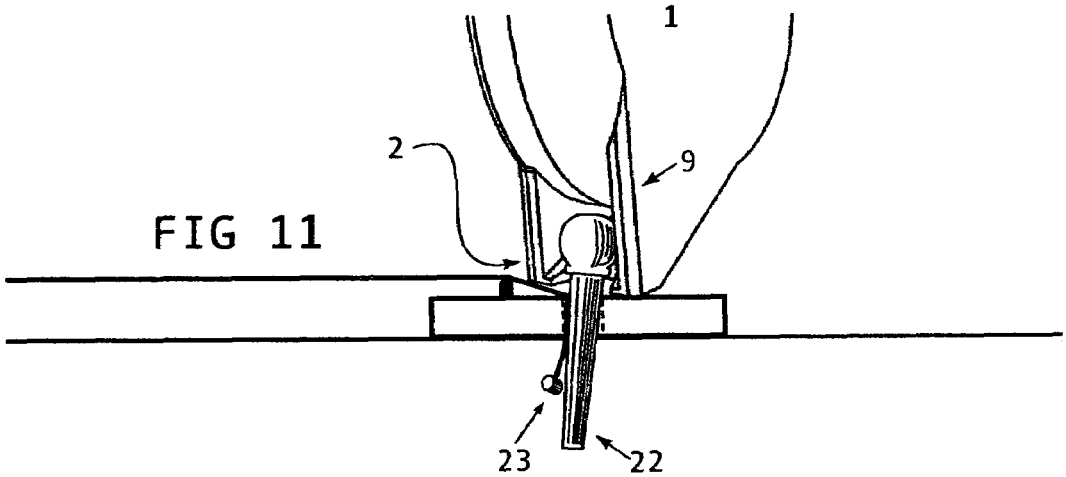
FIG. 11 shows the implementation of a bridge pin extractor.
Figure 12:
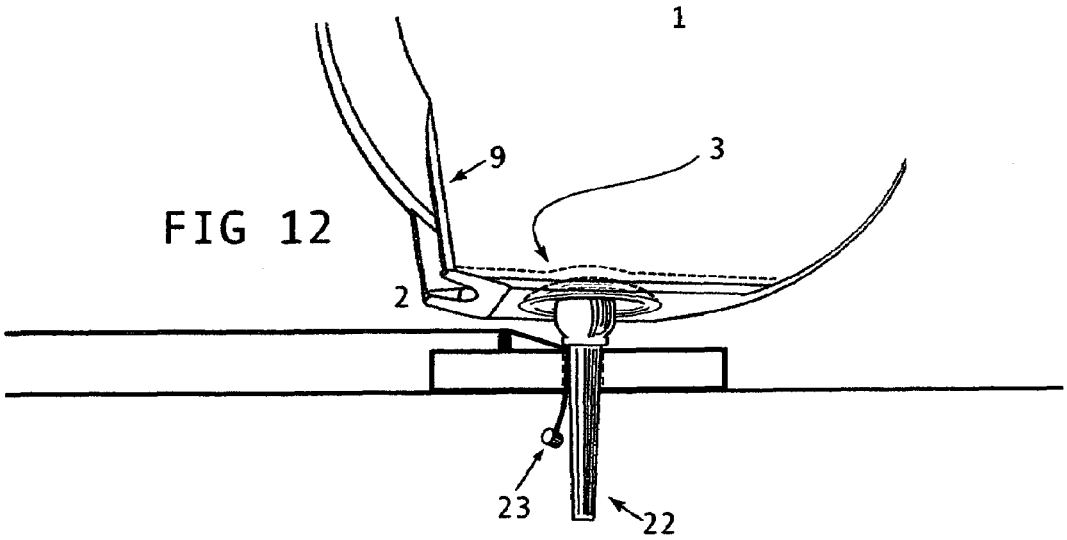
FIG. 12 shows the implementation of a bridge pin setter.

FIGS. 11 and 12

FIG. 11 shows pin tool structure 9 integral with extractor 2 and adjacent to the anchor of a guitar string 23 prying up a guitar pin 22 from a cutaway view of a typical acoustic guitar. FIG. 12 shows a recessed pin setter being used to apply pressure to the head of a pin 22, allowing for easy setting of the head without the need of using the thumb. This aspect of the tool can be especially appreciated after replacing all the guitar strings and having to reinstall and manually push-in several bridge pins. Advantages From the description above, a number of advantages of some embodiments of my planetary string winder tool becomes evident:

(a) The described is a simple, lightweight, one-handed tool capable of greatly assisting musicians, luthiers and technicians with a means of string winding whose performance heretofore is matched only by some power drivers.

(b) The wrist fatigue usually associated with instrument string changing will be prevented and the time and frustration lost to the task will be greatly reduced.

(c) The tactile feedback and self-aligning design of the tool prevents distortion or misalignment of a guitar key that could occur with a power driver.

(d) The integral bridge pin setter will save many a thumbs and could even prevent thumb injury, especially when replacing several strings at once.

(e) Having an integral bridge pin puller adds to the overall convenience of the tool.

Figure 13:
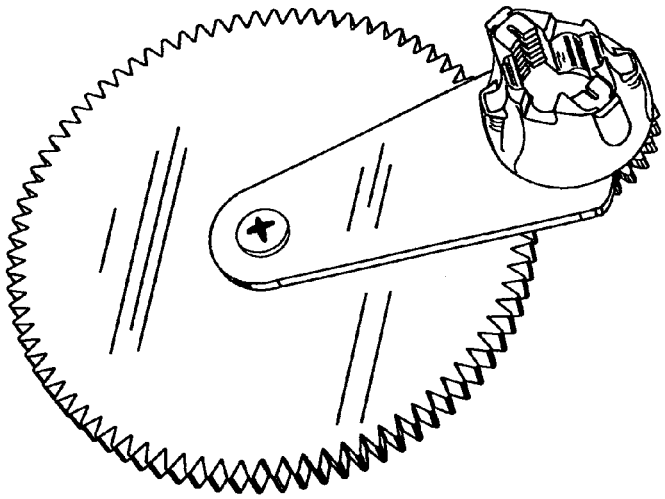
FIGS. 13-15 show three views of an alternative embodiment of the planetary musical instrument string winder.
Figure 14:
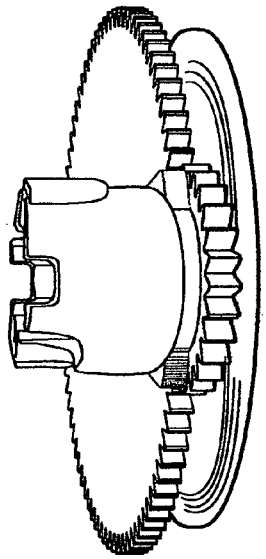
Figure 15:
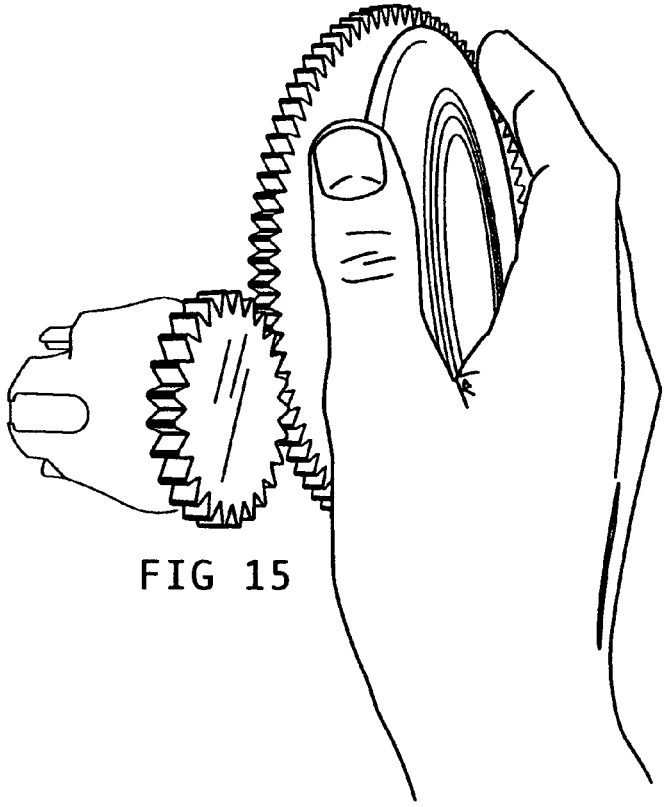

FIGS. 13, 14 and 15

Alternative Embodiments

Although the description above contains many specificalities, these should not be construed as limiting the scope of the embodiment but as merely providing illustrations of some of the presently preferred embodiments. For example, FIGS. 13, 14 and 15 provide an alternative construction of the Planetary String Winder For Musical Instrument. And while appearing quite different in execution from the above described embodiment, it will be noted that 13, 14 and 15 do convey the same essential features of the above detailed Planetary String Winder For Musical Instrument. It can be seen then by these general illustrations that the scope of the embodiment should be determined by the appended claims and their legal equivalents, rather than by only the detailed examples given.

What is claimed is:

1. A musical instrument string winder for engaging a musical instrument key for tightening or loosening a musical instrument string, said musical instrument string winder comprising:

(a) an operator gripping housing having first and second end portions, an integrally formed operator handle portion on one end portion, and a relatively large ring gear at the perimeter with a center bore on the second end portion, said ring gear having a predetermined diameter;

(b) a socket gear having first and second end portions, a socket for engaging a musical instrument key on one end portion and an integrally formed planet gear on the other end portion, said planet gear having a predetermined diameter and suitable structure to mate in conforming manner with said ring gear;

(c) a connecting element having first and second end portions, an integrally formed coupling on the first end portion to rotatably mount on said center bore and an integrally formed coupling on the second end portion that mates with said planet gear allowing axial rotation of said planet gear as well as orbital movement around said ring gear, whereby the musical instrument string winder can produce a greater number of rotations of the musical instrument key in accord to each single operator cycle of said handle.

2. The musical instrument string winder of claim 1, said ring gear having a perimeter three times greater or more than said planetary gear.

3. The musical instrument string winder of clam 1, said ring gear having a perimeter of three times greater or less than three times greater than said planetary gear.

4. The musical instrument string winder of claim 1, said ring gear being of an internal gear configuration contained in a handle housing.

5. The musical instrument string winder of claim 1, said ring gear being of an external ring gear configuration with a means for holding said ring gear configuration.

6. The musical instrument string winder of claim 1, said handle housing providing an integral, relatively small recessed area of sufficient depth to retain the head of a guitar bridge pin when applying exerted force upon it during insertion of it.

7. The musical instrument string winder of claim 6, said recessed area being less than 16 mm wide at any point.

8. The musical instrument string winder of claim 1, said handle housing integrally providing a protruding structure for prying and extracting a guitar bridge pin.

9. The musical instrument string winder of claim 1, said center bore being either elevated with or replaced by a center boss configuration.

10. The musical instrument string winder of claim 4, said connecting element formed in a way to serve as a cover for said internal gear and said planetary gear.

11. The musical instrument string winder of claim 1, said socket gear containg three or more axially aligned recesses to accept various sizes of said musical instrument key.

12. The musical instrument string winder of claim 1, said socket gear employing at least one recess whose wall extrusions are formed as a sum combination of two or more differently sized recesses that are longitudinally parallel and axially concentric with said socket gear to accept various sizes of said musical instrument key.

13. The musical instrument string winder of claim 1, said socket gear having at least one recess employing a mechanical means to maintain axial alignment with said socket gear of various sizes of said musical instrument key.

14. The musical instrument string winder of claim 1, said ring gear and planet gear being free of enmeshing gears and rather employing suitable friction drive surfaces to transmit rotational energy.

15. The musical instrument string winder of claim 1, wherein said handle, said key socket and said gears are fabricated from moldable polymer material.

* * * * *